US008839562B2

(12) United States Patent
Madrid

(10) Patent No.: US 8,839,562 B2
(45) Date of Patent: Sep. 23, 2014

(54) MORTISE LOCK ASSEMBLY AND METHOD OF ASSEMBLING

(75) Inventor: Allen L. Madrid, Peyton, CO (US)

(73) Assignee: Schlage Lock Company, Carmel, IN (US)

( * ) Notice: Subject to any disclaimer, the term of this patent is extended or adjusted under 35 U.S.C. 154(b) by 0 days.

(21) Appl. No.: 13/279,449

(22) Filed: Oct. 24, 2011

(65) Prior Publication Data

US 2013/0097938 A1 Apr. 25, 2013

(51) Int. Cl.
*E05C 1/12* (2006.01)
*E06B 3/70* (2006.01)

(52) U.S. Cl.
CPC .... *E05C 1/12* (2013.01); *E06B 3/70* (2013.01)
USPC ..... 49/395; 292/32; 292/37; 292/169; 292/140

(58) Field of Classification Search
USPC ..... 49/394, 395; 292/32, 33, 37, 38, 40, 42, 292/137, 138, 163, 169, 173, 171, 140, 143
See application file for complete search history.

(56) References Cited

U.S. PATENT DOCUMENTS 4,227,723 A * 10/1980 Rosell ..... 292/34
4,265,051 A * 5/1981 Williams ..... 49/7
4,288,944 A * 9/1981 Donovan ..... 49/395
4,362,328 A * 12/1982 Tacheny et al. ..... 292/36
4,639,021 A * 1/1987 Hope ..... 292/7
4,671,015 A * 6/1987 Curry et al. ..... 49/465
4,973,091 A * 11/1990 Paulson et al. ..... 292/51
5,290,077 A * 3/1994 Fleming ..... 292/35
5,901,989 A * 5/1999 Becken et al. ..... 292/35
6,120,071 A * 9/2000 Picard et al. ..... 292/165
6,174,004 B1 * 1/2001 Picard et al. ..... 292/165
6,209,931 B1 * 4/2001 Von Stoutenborough et al. ..... 292/160
6,282,929 B1 * 9/2001 Eller et al. ..... 70/109
6,929,293 B2 * 8/2005 Tonges ..... 292/332
6,971,686 B2 * 12/2005 Becken ..... 292/39
7,013,688 B2 * 3/2006 Chen ..... 70/107
7,377,076 B2 * 5/2008 Shedd ..... 49/449
7,404,306 B2 * 7/2008 Walls et al. ..... 70/107
7,497,486 B1 * 3/2009 Davis et al. ..... 292/32
7,707,862 B2 * 5/2010 Walls et al. ..... 70/107

(Continued)

OTHER PUBLICATIONS

Sargent—Assa Abloy, LP8600 & LR8600 Low Profile Center & Top Latch Concealed Vertical Rods for Pair of Doors & Double Egress, dated Sep. 15, 2011 (1 page).

*Primary Examiner* — Katherine Mitchell
*Assistant Examiner* — Justin Rephann
(74) *Attorney, Agent, or Firm* — Michael Best & Friedrich LLP

(57) ABSTRACT

A mortise lock comprising: a case having opposite inner and outer sides which are horizontally spaced when the mortise lock is mounted on a door; a latchbolt supported by the case for movement between extended and retracted positions, the latchbolt extending from the outer side of the case; an element configured to be operably connected to a latch adjacent a top or a bottom of the door, the element being movably supported by the case and partially extending from the inner side of the case; and a latchbolt bar movably supported by the case, the latchbolt bar having an outer end operably connected to the latchbolt for moving the latchbolt between the extended and retracted positions, and the latchbolt bar having an inner end operably connected to the element for moving the element when the latchbolt bar moves the latchbolt.

21 Claims, 7 Drawing Sheets

(56) References Cited

U.S. PATENT DOCUMENTS

| | | | | |
|---|---|---|---|---|
| 7,753,418 | B2 * | 7/2010 | Fleming | 292/336.3 |
| 7,856,857 | B2 * | 12/2010 | Tsai | 70/107 |
| 7,946,080 | B2 * | 5/2011 | Ellerton et al. | 49/395 |
| 8,167,386 | B2 * | 5/2012 | Bergesch et al. | 312/215 |
| 8,182,002 | B2 * | 5/2012 | Fleming | 292/40 |
| 2002/0104339 | A1 * | 8/2002 | Saner | 70/108 |
| 2005/0229657 | A1 * | 10/2005 | Johansson et al. | 70/107 |
| 2008/0211239 | A1 * | 9/2008 | Keller | 292/164 |
| 2008/0303290 | A1 * | 12/2008 | Yuan | 292/195 |
| 2012/0248789 | A1 * | 10/2012 | Mattrisch | 292/33 |
| 2013/0026768 | A1 * | 1/2013 | Nolte et al. | 292/42 |

* cited by examiner

MORTISE LOCK ASSEMBLY AND METHOD OF ASSEMBLING

BACKGROUND

The present invention relates to mortise locks and to doors with a lock at the top and/or bottom of the door.

SUMMARY

The invention provides a mortise lock comprising a case having opposite inner and outer sides which are horizontally spaced when the mortise lock is mounted on a door, a latchbolt supported by the case for movement between extended and refracted positions, the latchbolt extending from the outer side of the case, an element configured to be operably connected to a latch adjacent a top or a bottom of the door, the element being movably supported by the case and partially extending from the inner side of the case, and a latchbolt bar movably supported by the case, the latchbolt bar having an outer end operably connected to the latchbolt for moving the latchbolt between the extended and retracted positions, and the latchbolt bar having an inner end operably connected to the element for moving the element when the latchbolt bar moves the latchbolt.

The invention also provides a mortise lock comprising a case having opposite inner and outer sides which are horizontally spaced when the mortise lock is mounted on a door, a latchbolt supported by the case for movement between extended and refracted positions, the latchbolt moving horizontally between the extended and retracted positions when the mortise lock is mounted on the door, and the latchbolt extending from the outer side of the case, an element mounted on the case for pivotal movement about an axis which is horizontal and perpendicular to a vertical plane defined by a direction of movement of the latchbolt when the mortise lock is mounted on the door, the element partially extending from the inner side of the case, the element including an element surface outside of the case, the element surface moving vertically when the mortise lock is mounted on the door and when the latchbolt moves to the retracted position, a latchbolt bar movably supported by the case, the latchbolt bar having an outer end operably connected to the latchbolt for moving the latchbolt between the extended and retracted positions, the latchbolt bar moving along a horizontal line beneath the axis when the mortise lock is mounted on the door, and the latchbolt bar having an inner end operably connected to the element for moving the element when the latchbolt bar moves the latchbolt, and a rod which is entirely outside of the case and is configured to be operably connected to a latch adjacent a top or a bottom of the door, which extends vertically when the mortise lock is mounted on the door, and which has therein a recess into which the element extends, the recess being at least partially defined by a rod surface, the rod surface being engaged by the element surface and the rod moving in response to movement of the element.

The invention also provides a method of operating a latch mounted adjacent a top or a bottom of a door, the method comprising providing the door with an internal rod operably connected to the latch, thereafter mounting on the door a mortise lock including a case, a latchbolt supported by the case for movement between extended and retracted positions, and a manually movable member operably connected to the latchbolt for moving the latchbolt between the extended and retracted positions, and operating the latch via the rod in response to movement of the latchbolt.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
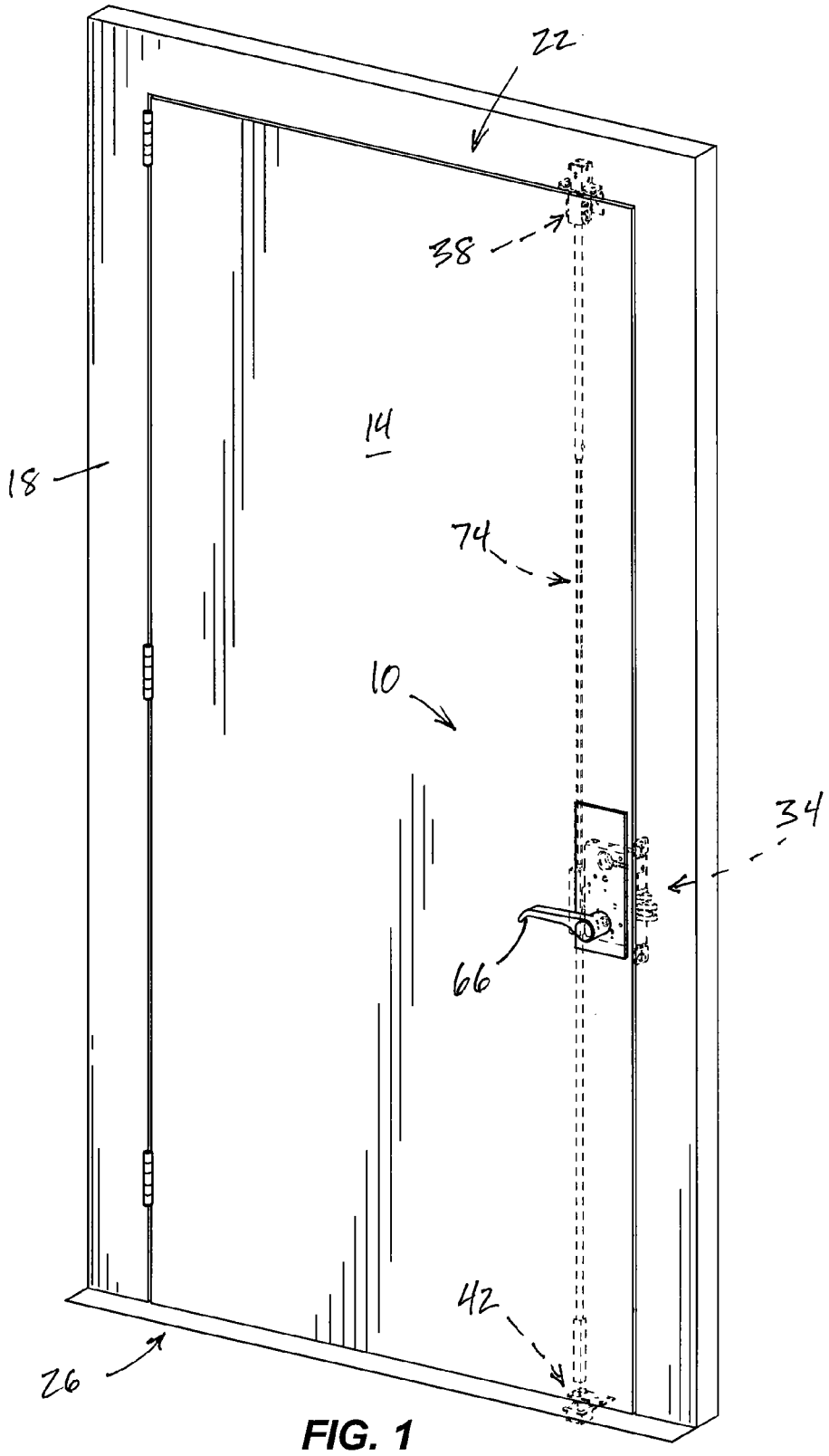
FIG. 1 is a perspective view of a lock assembly embodying the invention.

FIG. 1 shows a lock assembly 10 mounted on a door 14. The door is mounted in a door frame 18 and has a top 22 and a bottom 26. The lock assembly 10 comprises a mortise lock 34 mounted on the door, an upper latch 38 mounted adjacent the top 22 of the door, and a lower latch 42 mounted adjacent the bottom 26 of the door.

Figure 4:
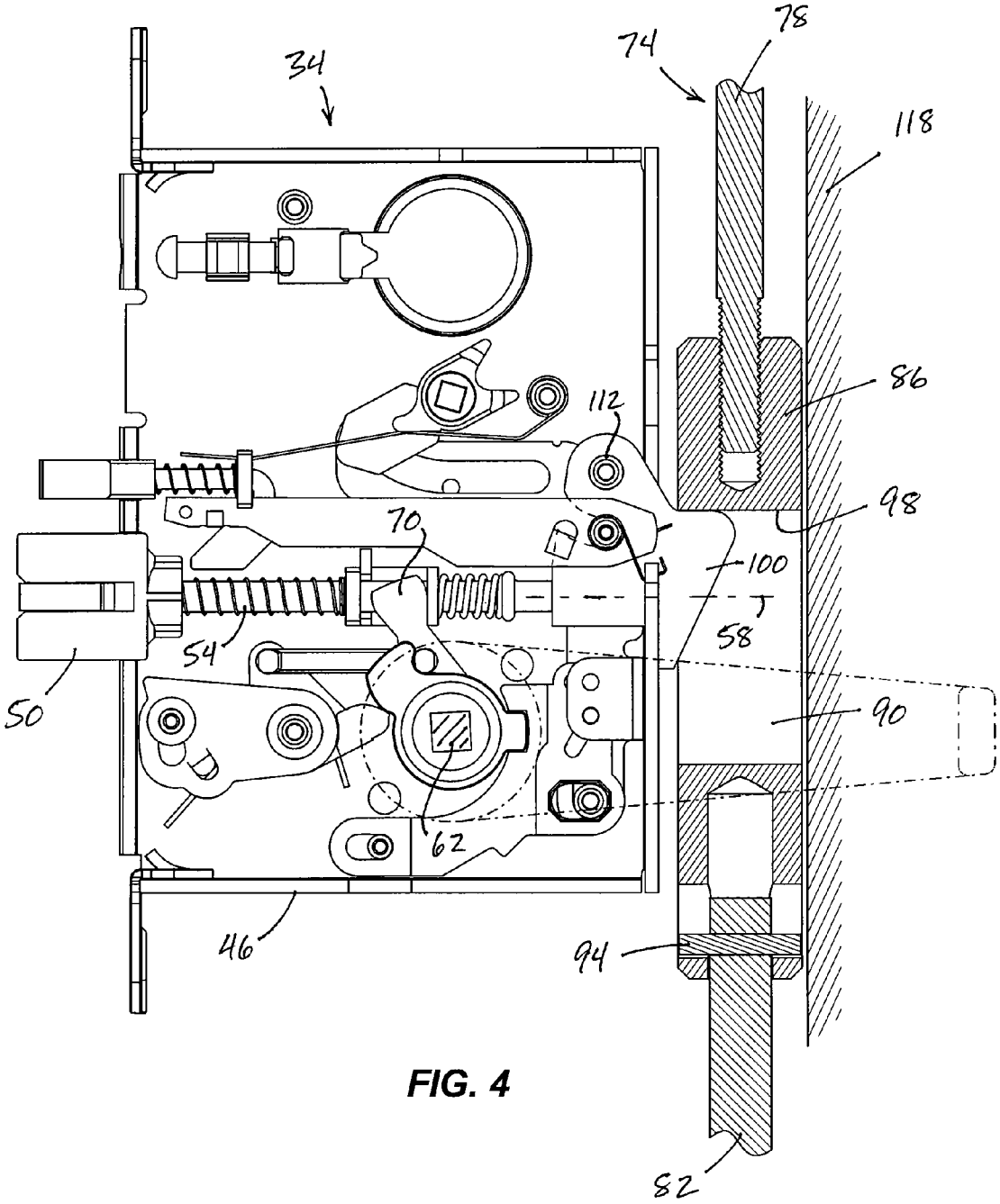
FIG. 4 is an enlarged elevational view, partially in section, of the mortise lock with the latchbolt in its extended position.
Figure 5:
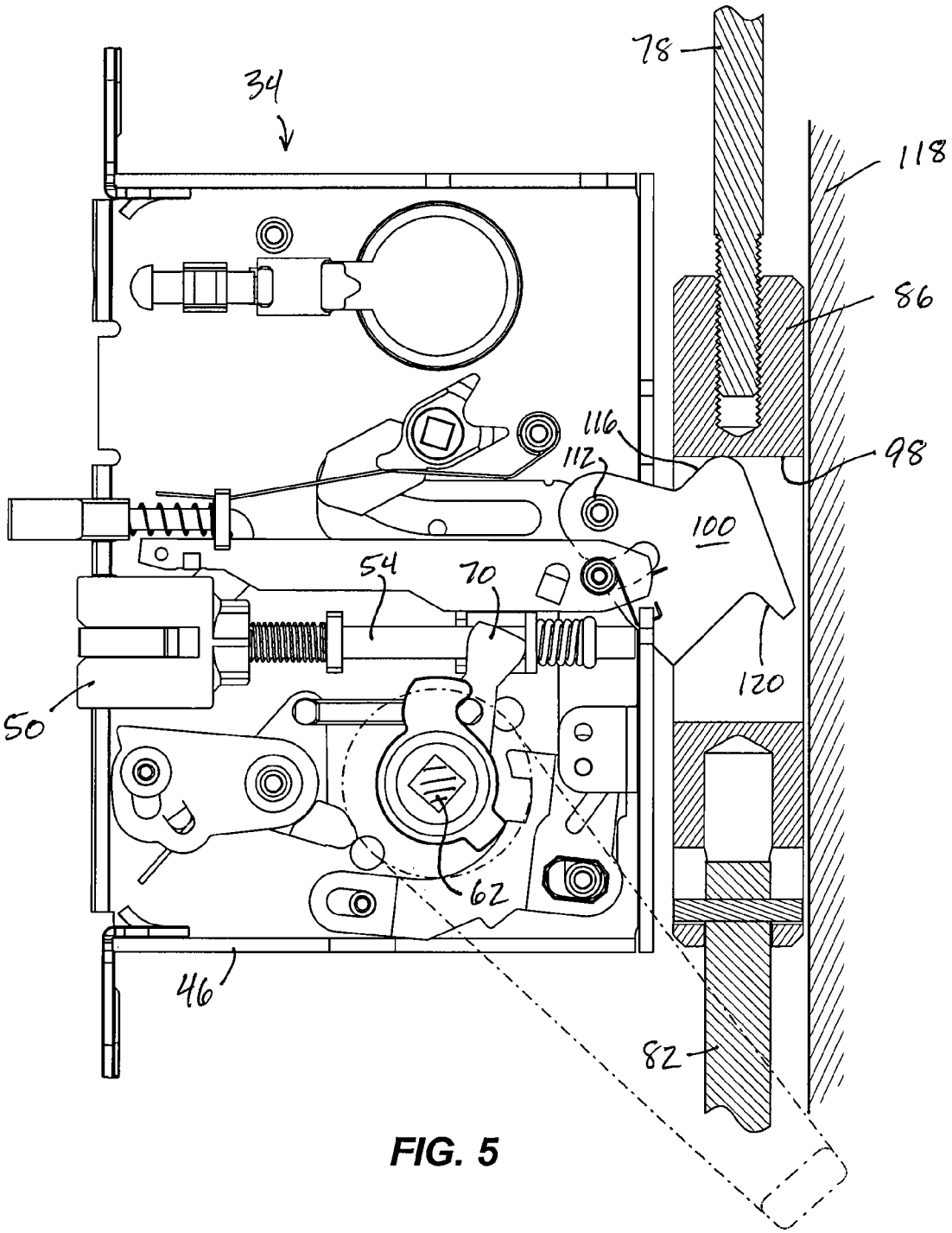
FIG. 5 is an enlarged elevational view, partially in section, of the mortise lock with the latchbolt in its retracted position.

The mortise lock 34 is best shown in FIGS. 4 and 5. Some elements of the lock not related to the invention are not shown. The mortise lock 34 includes a chassis case 46 and a latchbolt 50 supported by the case 46 for movement between an extended position (FIG. 4) and a retracted position (FIG. 5). The mortise lock 34 also includes a latchbolt bar 54 operably connected to the latchbolt 50 for moving the latchbolt between the extended and retracted positions. The latchbolt bar can either be a separate piece connected to the latchbolt in any suitable manner, or the latchbolt bar and the latchbolt can be unitary. The latchbolt bar 54 has a generally horizontal longitudinal axis 58 and moves along the axis. The mortise lock 34 also includes a spindle 62 that extends generally horizontally and generally perpendicular to the plane of the door. Interior and exterior manually movable members, such as handles or levers, are connected to the opposite ends of the spindle 62. One lever 66 is shown in FIG. 1. Other types of manually movable members, such as door knobs, can be used. A crank member 70 operably connects the spindle 62 to the latchbolt bar 54 for causing translational movement of the latchbolt bar 54 in response to pivotal movement of the spindle. The mortise lock 34 as thus far described is conventional and need not be described in greater detail. An example of such a mortise lock is the Schlage L9000 Series Mortise Lock, which is known in the art. It should be understood that the invention is applicable to other types of mortise locks and to locks made by other manufacturers.

Figure 2:
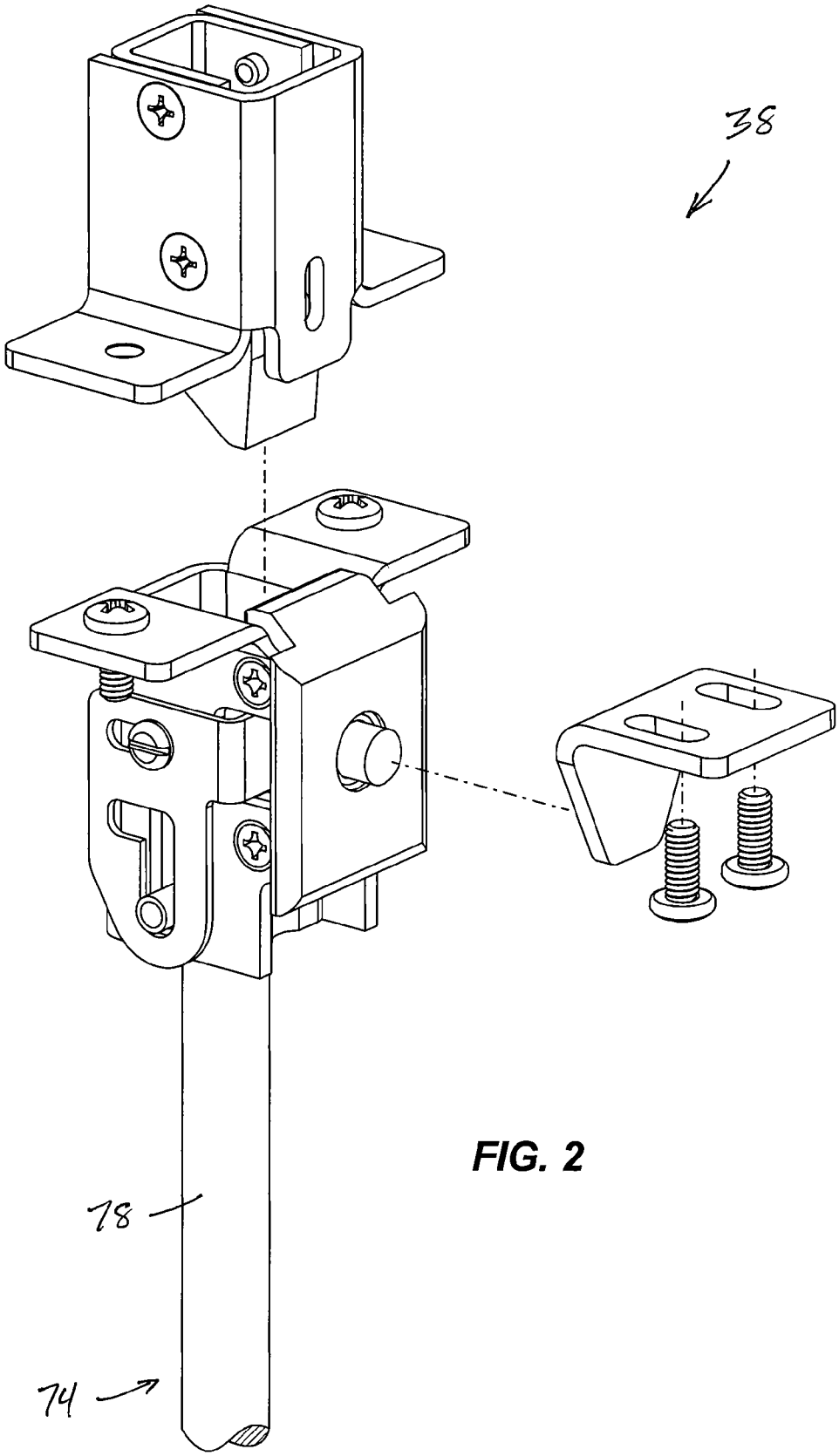
FIG. 2 is an enlarged, exploded perspective view of the upper latch.
Figure 3:
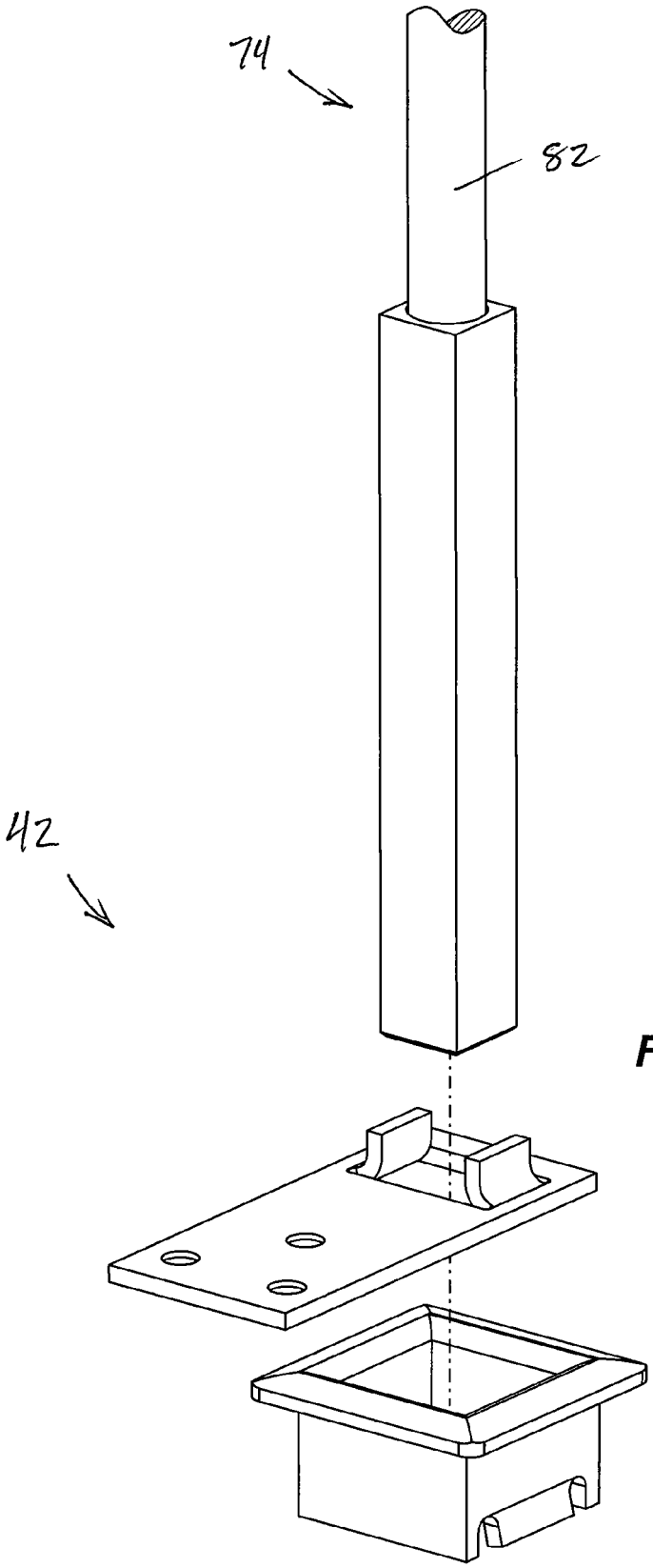
FIG. 3 is an enlarged, exploded perspective view of the lower latch.

The lock assembly 10 also includes a vertical rod 74 inside the door 14. The upper end of the rod 74 is operably connected to the upper latch 38, which is best shown in FIG. 2. The upper latch 38 is a soffit latch and ratchet release. Part of the upper latch 38 is mounted in the door, and part is mounted in the door frame. Upward movement of the rod 74 opens or releases the upper latch 38. Also, the rod 74 is held in its upper position until the door is closed, at which time the rod 74 is released and is allowed to drop back to its original position. The upper latch 38 will not otherwise be described in detail. The invention is applicable to any upper latch that can be actuated by movement of a vertical rod. The lower end of the rod 74 is operably connected to the lower latch. Actually, in the construction shown in FIG. 3, the lower end of the rod 74 is part of the lower latch 42. The lower end of the rod 74 extends into a recess in the floor when the lower latch 42 is closed or engaged, and the lower end of the rod 74 is retracted from the recess when the lower latch 42 is open or disengaged. Thus, upward movement of the rod 74 releases the lower latch 42, and downward movement of the rod 74 engages the lower latch 42. The lower latch will not otherwise be described in detail. The invention is applicable to any lower latch that can be actuated by movement of a vertical rod. The vertical rod 74 and the latches 38 and 42 as thus far described are also conventional. An example of such a vertical rod and two-point latch is the Von Duprin 237, which is known in the art. It should be understood that the invention is applicable to other types of rods and latches and to those made by other manufacturers.

In the illustrated construction, as best shown in FIGS. 4 and 5, the rod 74 includes upper and lower sections 78 and 82, respectively, connected by a middle section 86. The upper end of the lower section 82 extends into a recess in the middle section 86 and is secured to the middle section 86 by a pin 94. The lower end of the upper section 78 is threaded into a recess in the middle section 86. Upward movement of the middle section 86 pulls the lower section 82 upward and pushes the upper section 78 upward. The middle section 86 has therein a recess 90 opening toward the case 46 of the mortise lock. The recess 90 is partially defined by a horizontal, downwardly-facing rod surface 98.

Movement of the rod 74 is controlled by an auxiliary mechanism in the mortise lock 34. The auxiliary mechanism includes (see FIGS. 4-6) an element or cam member or lifter 100 pivotally mounted inside the case 46, with the lifter 100 partially extending from the inner side or rear of the case. More particularly, the inner side of the case 46 has therein an opening 104 through which the lifter 100 extends. The lifter 100 is pivotable relative to the case about a horizontal axis 108 that is perpendicular to the plane of the door or perpendicular to the vertical plane defined by the direction of movement of the latchbolt 50, or defined by the longitudinal axis 58 of the latchbolt bar 54. The axis 108 is above the latchbolt bar 54, such that the latchbolt bar moves along a line (axis 58) beneath the axis 108 of the lifter 100. In the illustrated construction, the lifter 100 hangs from and pivots about a pin or post 112 that is mounted on the chassis case 46 and that extends along the axis 108. The lifter 100 is pivotable between a non-actuated position shown in FIGS. 4 and 6 and an actuated position shown in FIG. 5.

The lifter 100 has an outer or left side and an inner or right side. The inner side of the lifter 100 includes (see FIG. 6) an element surface or lifter surface 116 outside of the case 46. The surface 116 extends horizontally when the lifter 100 is in the non-actuated position. The surface 116 moves vertically, and specifically upward, when the lifter 100 moves to the actuated position. The rod surface 98 rests on the lifter surface 116 such that the rod 74 moves upward when the lifter surface 116 moves upward. Thus, movement of the lifter 100 from the non-actuated position to the actuated position moves the rod 74 upward and thereby, as described above, releases the upper and lower latches. Because pivotal movement of the lifter 100 may also exert a horizontal force (to the right) on the rod 74, the door includes a wall 118 limiting movement of the rod 74 to the right or away from the case 46.

The lifter 100 also includes an engagement surface 120 that engages the outer surface of the case 46. Such engagement limits clockwise movement of the lifter 100 and defines the non-actuated position of the lifter 100. The surface 120 extends vertically when the lifter 100 is in the non-actuated position. In the illustrated construction, the lifter 100 has therein an arcuate slot 124 that provides clearance for a pin 128 that is fixed to the case 46 and that performs a function unrelated to the invention. The slot 124 would not be necessary with some mortise locks.

Figure 6:
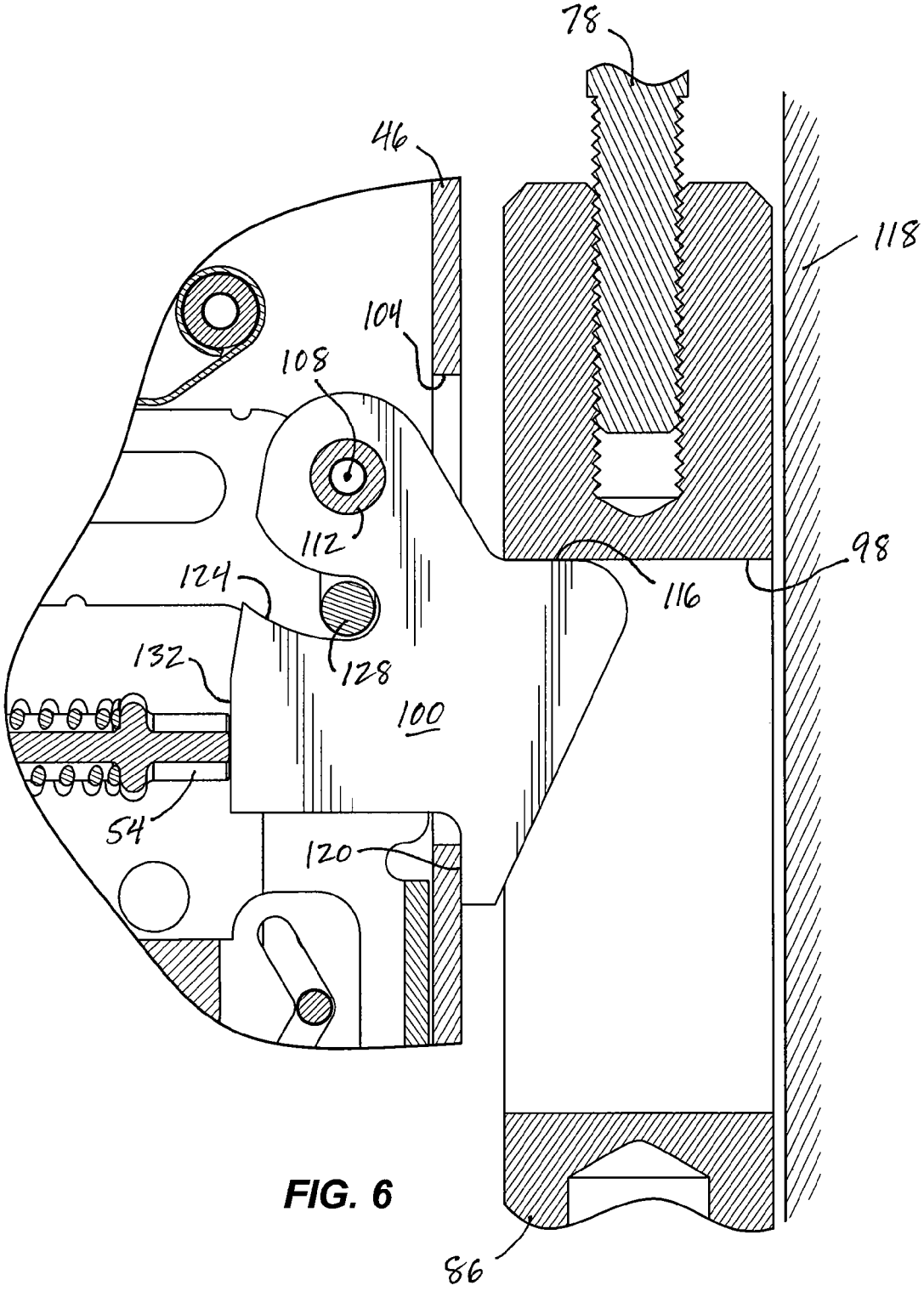
FIG. 6 is a further enlarged view of the lifter.

As shown in FIG. 6, a surface 132 on the outer or left side of the lifter 100 is engaged by the inner or tail end of the latchbolt bar 54. The surface 132 extends vertically when the lifter is in its non-actuated position. In this way the latchbolt bar 54 is operably connected to the lifter 100 such that movement of the latchbolt bar 54 to the right (when the latchbolt 50 moves to the retracted position) moves the lifter 100 from its non-actuated position to its actuated position. While in the illustrated construction the latchbolt bar 54 only pushes against, and is not otherwise connected to, the lifter 100, other types of connections are possible, so long as the lifter 100 pivots in response to movement of the latchbolt bar 54. When the latchbolt bar 54 moves to the left as the latchbolt moves to its extended position, the lifter 100 returns to its non-actuated position, which allows the rod 74 to drop when it is released by the upper latch 38 when the door closes.

Because the mortise lock 34 engages the rod 74 from the rear or inner side of the case 46, and the rod is entirely outside of the case, the mortise lock can be installed or removed from a door while the door is in place. Preferably, the door is provided with the rod 74 operably connected to the portion of the upper latch 38 that is in the door. The door can be mounted on the door frame, and then the mortise lock 34 is mounted on the door. When the lock 34 is mounted on the door, the lifter 100 is inserted into the recess 90 so that the lifter 100 engages the rod 74. The lock 34 is then operated as described above. Because the rod 74 does not pass through the case 46, the lock does not have to be installed in the door prior to the rod, or prior to hanging the door.

Figure 7:
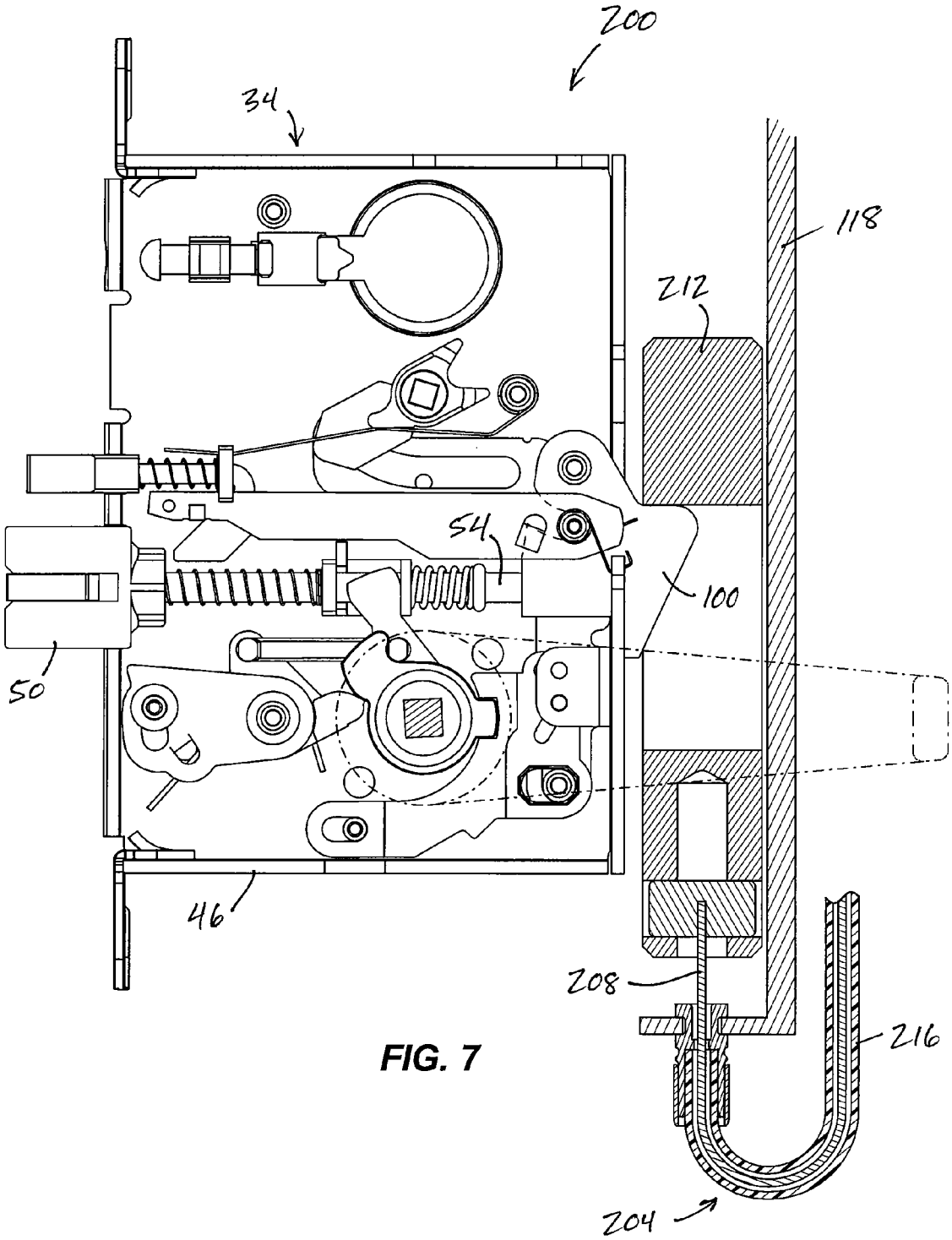
FIG. 7 is a view similar to FIG. 4 showing an alternative embodiment of the invention.

FIG. 7 shows an alternative lock assembly 200. Except as described below, the lock assembly 200 is substantially identical to the lock assembly 10, and common elements have been given the same reference numerals. Rather than using a rod to actuate the upper and lower latches, the lock assembly 200 uses a non-rigid device, and specifically a cable 204. The cable has an inner core 208 fixed to a vertically movable member 212 that is similar to the middle section 86 of the lock assembly 10. The member 212 moves in response to movement of the lifter 100 in the same way the rod 74 moves. The cable 204 also has a sheath 216 that is fixed relative to the door. The opposite end of the cable 204 is connected to an upper latch (not shown). One skilled in the art can easily understand how the latch 38 can be actuated by the cable, or other types of latches can be employed. The upper latch can be connected to a lower latch by another cable, or another cable can be connected between the member 212 and a lower latch. Also, a push-pull cable can be connected between the top of the member 212 and the upper latch.

Various features and advantages of the invention are set forth in the following claims.

The invention claimed is:

1. A mortise lock comprising:

a case having opposite inner and outer sidewalls which are horizontally spaced when the mortise lock is mounted on a door;

a latchbolt supported by the case for movement between extended and refracted positions, the latchbolt extending from the outer sidewall of the case;

an element configured to be operably connected to a latch adjacent a top or a bottom of the door, the element being movably supported by the case and partially extending from the inner sidewall of the case; and a latchbolt bar movably supported by the case, the latchbolt bar having an outer end operably connected to the latchbolt for moving the latchbolt between the extended and refracted positions, and the latchbolt bar having an inner end operably connected to the element for moving the element when the latchbolt bar moves the latchbolt.

2. A mortise lock according to claim 1 wherein the element is pivotally mounted on the case.

3. A mortise lock according to claim 2 wherein the element includes an element surface outside of the case, wherein the latchbolt moves horizontally between the extended and retracted positions when the mortise lock is mounted on the door, and wherein the element surface moves vertically when the mortise lock is mounted on the door and when the latchbolt moves to the retracted position.

4. A mortise lock according to claim 3 and further comprising a rod which is entirely outside of the case, which is engaged by the element surface and which moves in response to movement of the element.

5. A mortise lock according to claim 4 wherein the rod extends vertically when the mortise lock is mounted on the door, and wherein the rod is configured to be operably connected to the latch.

6. A mortise lock according to claim 5 wherein the rod has therein a recess into which the element extends, the recess being at least partially defined by a rod surface, and wherein the element surface engages the rod surface to move the rod in response to movement of the element.

7. A mortise lock according to claim 3 wherein the element is pivotable about an axis which is horizontal and perpendicular to a vertical plane defined by a direction of movement of the latchbolt when the mortise lock is mounted on the door.

8. A mortise lock according to claim 7 wherein the latchbolt bar moves along a horizontal line beneath the axis when the mortise lock is mounted on the door.

9. A mortise lock according to claim 8 wherein the element has an outer side engaged by the latchbolt bar, and wherein the element surface is on an opposite inner side of the element.

10. A mortise lock according to claim 1 and further comprising a manually movable member operably connected to the latchbolt bar for moving the latchbolt bar so as to move the latchbolt between the extended and retracted positions.

11. A mortise lock according to claim 1 wherein the case has an outer surface, wherein the element is movable between actuated and non-actuated positions respectively corresponding to the retracted and extended positions of the latchbolt, and wherein the element has an engagement surface which engages the outer surface of the case when the element is in the non-actuated position.

12. A mortise lock according to claim 1 and further comprising a non-rigid device configured to be operably connected to the latch, and wherein the element is operably connected to the non-rigid device.

13. A mortise lock according to claim 12 wherein the non-rigid device includes a cable.

14. A mortise lock comprising:

a case having opposite inner and outer sidewalls which are horizontally spaced when the mortise lock is mounted on a door;

a latchbolt supported by the case for movement between extended and refracted positions, the latchbolt moving horizontally between the extended and retracted positions when the mortise lock is mounted on the door, and the latchbolt extending from the outer sidewall of the case;

an element mounted on the case for pivotal movement about an axis which is horizontal and perpendicular to a vertical plane defined by a direction of movement of the latchbolt when the mortise lock is mounted on the door, the element partially extending from the inner sidewalk of the case, the element including an element surface outside of the case, the element surface moving vertically when the mortise lock is mounted on the door and when the latchbolt moves to the refracted position;

a latchbolt bar movably supported by the case, the latchbolt bar having an outer end operably connected to the latchbolt for moving the latchbolt between the extended and refracted positions, the latchbolt bar moving along a horizontal line beneath the axis when the mortise lock is mounted on the door, and the latchbolt bar having an inner end operably connected to the element for moving the element when the latchbolt bar moves the latchbolt; and a rod which is entirely outside of the case and is configured to be operably connected to a latch adjacent a top or a bottom of the door, which extends vertically when the mortise lock is mounted on the door, and which has therein a recess into which the element extends, the recess being at least partially defined by a rod surface, the rod surface being engaged by the element surface and the rod moving in response to movement of the element.

15. A mortise lock according to claim 14 wherein the lock further comprises an upper latch, and wherein the rod has an upper end operably connected to the upper latch.

16. A mortise lock according to claim 14 wherein the lock further comprises a lower latch, and wherein the rod has a lower end operably connected to the lower latch.

17. A method of operating a latch mounted adjacent a top or a bottom of a door, the method comprising:

providing the door with an internal rod operably connected to the latch;

thereafter mounting on the door a mortise lock including a case having opposite inner and outer sidewalls which are horizontally spaced when mounted on the door, a latchbolt supported by the case for movement between extended and retracted positions, the latchbolt extending from the outer sidewall of the case, an element operably connected to the latch, the element being movably supported by the case and partially extending from the inner sidewall of the case, a latchbolt bar movably supported by the case, the latchbolt bar having an outer end operably connected to the latchbolt for moving the latchbolt between the extended and retracted positions, and the latchbolt bar having an inner end operably connected to the element for moving the element when the latchbolt bar moves the latchbolt, and a manually movable mem ber operably connected to the latchbolt bar for moving the latchbolt between the extended and retracted positions; and operating the latch via the rod in response to movement of the element caused by movement of the latchbolt bar.

18. A method according to claim 17 wherein mounting the mortise lock on the door includes engaging the rod with the element.

19. A method according to claim 18 wherein the rod has therein a recess at least partially defined by a rod surface, wherein engaging the rod with the element includes extending the element into the recess while mounting the mortise lock on the door, and wherein operating the latch includes engaging the rod surface with the element surface in response to movement of the latchbolt.

20. A method according to claim 17 wherein the door is mounted on a door frame prior to mounting the mortise lock on the door.

21. A mortise lock comprising:

a case having opposite inner and outer sidewalls which are horizontally spaced when the mortise lock is mounted on a door;

a latchbolt supported by the case such that the latchbolt is movable between extended and retracted positions, the latchbolt extending from the outer sidewall of the case;

an element configured to be operably connected to a latch adjacent a top or a bottom of the door, the element being movably supported by the case and partially extending from the inner sidewall of the case; and a latchbolt bar movably supported by the case, the latchbolt bar having an outer end operably connected to the latchbolt such that the latchbolt bar moves the latchbolt between the extended and retracted positions, and the latchbolt bar having an inner end operably connected to the element such that the latchbolt bar moves the element when the latchbolt bar moves the latchbolt.

* * * * *

UNITED STATES PATENT AND TRADEMARK OFFICE

CERTIFICATE OF CORRECTION

PATENT NO. : 8,839,562 B2
APPLICATION NO. : 13/279449
DATED : September 23, 2014
INVENTOR(S) : Allen L. Madrid It is certified that error appears in the above-identified patent and that said Letters Patent is hereby corrected as shown below:

In the Claims

Column 5, claim 1, line 7: replace the word “refracted” with the word --retracted--

Column 5, claim 1, line 16: replace the word “refracted” with the word --retracted--

Column 6, claim 14, line 8: replace the word “refracted” with the word --retracted--

Column 6, claim 14, line 17: replace the word “sidewalk” with the word --sidewall--

Column 6, claim 14, line 22: replace the word “refracted” with the word --retracted--

Column 6, claim 14, line 26: replace the word “refracted” with the word --retracted--

Column 6, claim 17, line 68: insert a -- - -- after the phrase “movable mem”

Signed and Sealed this
Seventeenth Day of February, 2015

Michelle K. Lee

Michelle K. Lee
*Deputy Director of the United States Patent and Trademark Office*